US007917077B2

(12) United States Patent
Shimizu et al.

(10) Patent No.: US 7,917,077 B2
(45) Date of Patent: Mar. 29, 2011

(54) WASTE-TONER HOUSING DEVICE, AND IMAGE FORMING APPARATUS

(75) Inventors: Yoshiyuki Shimizu, Osaka (JP); Kenzo Tatsumi, Osaka (JP); Yoshihiro Kawakami, Hyogo (JP); Tomohiro Kubota, Osaka (JP); Koji Kato, Osaka (JP); Hirobumi Ooyoshi, Osaka (JP); Tomofumi Yoshida, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 523 days.

(21) Appl. No.: 11/870,104

(22) Filed: Oct. 10, 2007

(65) Prior Publication Data

US 2008/0089727 A1 Apr. 17, 2008

(30) Foreign Application Priority Data

Oct. 11, 2006 (JP) ..... 2006-277341
Jul. 5, 2007 (JP) ..... 2007-177437

(51) Int. Cl.
*G03G 21/12* (2006.01)
*G03G 21/00* (2006.01)

(52) U.S. Cl. ..... 399/360; 399/358

(58) Field of Classification Search ..... 399/358, 399/359, 360, 123, 120, 99, 35
See application file for complete search history.

(56) References Cited

U.S. PATENT DOCUMENTS

| | | | | |
|---|---|---|---|---|
| 5,933,690 | A * | 8/1999 | Sugimoto et al. | 399/257 |
| 6,937,838 | B2 * | 8/2005 | Ishii et al. | 399/358 |
| 2006/0188302 | A1 * | 8/2006 | Stafford et al. | 399/358 |
| 2007/0104523 | A1 | 5/2007 | Yoshida et al. | |

FOREIGN PATENT DOCUMENTS

| | | |
|---|---|---|
| JP | 11-258962 | 9/1999 |
| JP | 2004-102137 | 4/2004 |

OTHER PUBLICATIONS

U.S. Appl. No. 11/870,136, filed Oct. 10, 2007, Tatsumi, et al.
U.S. Appl. No. 12/103,941, filed Apr. 16, 2008, Shimizu.
U.S. Appl. No. 12/170,842, filed Jul. 10, 2008, Kubota, et al.
U.S. Appl. No. 12/257,547, filed Oct. 24, 2008, Kubota, et al.

* cited by examiner

*Primary Examiner* — David P Porta
*Assistant Examiner* — Faye Boosalis
(74) *Attorney, Agent, or Firm* — Oblon, Spivak, McClelland, Maier & Neustadt, L.L.P.

(57) ABSTRACT

A waste-toner housing device that is detachably attached to an image forming apparatus for housing waste toner includes a waste-toner container and a first conveying member and a second conveying member that convey the wasted toner. The first conveying member and the second conveying member are arranged inside the waste-toner container in such a manner that the second conveying member is located at an elevated level with respect to the first conveying member.

14 Claims, 6 Drawing Sheets

WASTE-TONER HOUSING DEVICE, AND IMAGE FORMING APPARATUS

CROSS-REFERENCE TO RELATED APPLICATIONS

The present application claims priority to and incorporates by reference the entire contents of Japanese priority document, 2006-277341 filed in Japan on Oct. 11, 2006 and 2007-177437 filed in Japan on Jul. 5, 2007.

BACKGROUND OF THE INVENTION

1. Field of the Invention

The present invention relates to a waste-toner housing device for use in an image forming apparatus, and an image forming apparatus.

2. Description of the Related Art

In conventional image forming apparatuses such as copiers, facsimile machines, and printers, a service staff generally carries out replacement of consumable or life-limited components and maintenance of them. However, the trend is changing and the user is carrying out exchange of supplies and maintenance. In addition, smaller components are used for suppressing the size and the cost of the image forming apparatus. Therefore, the user needs to periodically exchange parts that deteriorate in quality earlier than the life of the apparatus or a waste-toner container. The waste-toner container contains residual materials such as toner, which is a developer, or fiber from transfer sheets. Moreover, because the image forming apparatus is installed adjacent to a user of a personal computer in the times of widespread use of personal computers reduction of noise during operation of the image forming apparatus is another problem that needs attention.

Toner that fails to be transferred onto the transfer sheet is removed and conveyed into a waste-toner container. To recycle the waste toner, an additional path and an additional driving unit for collecting the waste toner becomes necessary. As a result, the image forming apparatus becomes larger. The waste toner contains foreign materials such as fiber from the transfer sheets. Removal of the fiber makes control process or reuse process complicated. If a full-color image forming apparatus that uses three or four toners performs the waste-toner recycling process, considerably larger waste-toner container is required so that structure of the full-color image forming apparatus becomes much complicated. For this reason, in some of the image forming apparatuses, the waste toner is just conveyed into the waste-toner container and the waste-toner container is replaced with another one when the waste-toner container is full with the waste toner.

It is possible to provide a waste-toner container that can contain all the waste toner generated during a whole life of the apparatus. However, such a waste-toner container is considerably large. Therefore, there is a need for filling the waste toner into the waste-toner container in an effective manner to decrease the frequency of replacing the waste-toner container. The waste toner is poured into the waste-toner container from the top, and a sensor is installed on the top part of the waste-toner container. The sensor is a detecting unit for detecting whether the waste-toner container is filled to its capacity and for notifying time of exchange. Exchange cycle of the waste-toner container is prolonged if the waste-toner container is filled with the waste toner without an unfilled space, that is, the waste toner does not accumulate in one particular part of the waste-toner container.

In the conventional image forming apparatus two methods are used to properly fill up the waste-toner container. One method is to periodically shake the waste-toner container and the other method is to locate an agitating screw on the top part of the waste-toner container to flatten a pile of the waste toner inside the waste-toner container.

Japanese Patent Application Laid-Open No. H11-258962 discloses an image forming apparatus in which waste toner removed by the cleaning device is mixed with fresh toner supplied to a developing device, and mixed toner is conveyed to an agitating unit. An accumulating unit is formed in front of the mixing unit in the image forming apparatus. In the image forming apparatus the fresh toner is fed to the accumulating unit and the waste toner is returned to the accumulating unit. Japanese Patent Application Laid-Open No. 2004-102137 discloses an image forming apparatus that includes a waste-toner housing device that is shaped able to fit into a spare space in a main body of the image forming apparatus. The waste-toner housing device includes a waste container and a conveying member that conveys collected waste toner within the waste-toner container.

However, in the conventional image forming apparatus, collected waste toner is piled up in one part of the waste-toner container, and space in the waste-toner container is not effectively filled.

SUMMARY OF THE INVENTION

It is an object of the present invention to at least partially solve the problems in the conventional technology.

According to an aspect of the present invention, there is provided a waste-toner housing device detachably attached to an image forming apparatus for housing waste toner generated in the image forming apparatus. The waste-toner housing device includes a waste-toner container; and a first conveying member and a second conveying member that convey the wasted toner. The first conveying member and the second conveying member are arranged inside the waste-toner container in such a manner that the second conveying member is located on an elevated level with respect to the first conveying member.

According to another aspect of the present invention, there is provided an image forming apparatus. The image forming apparatus includes the waste-toner housing device described above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
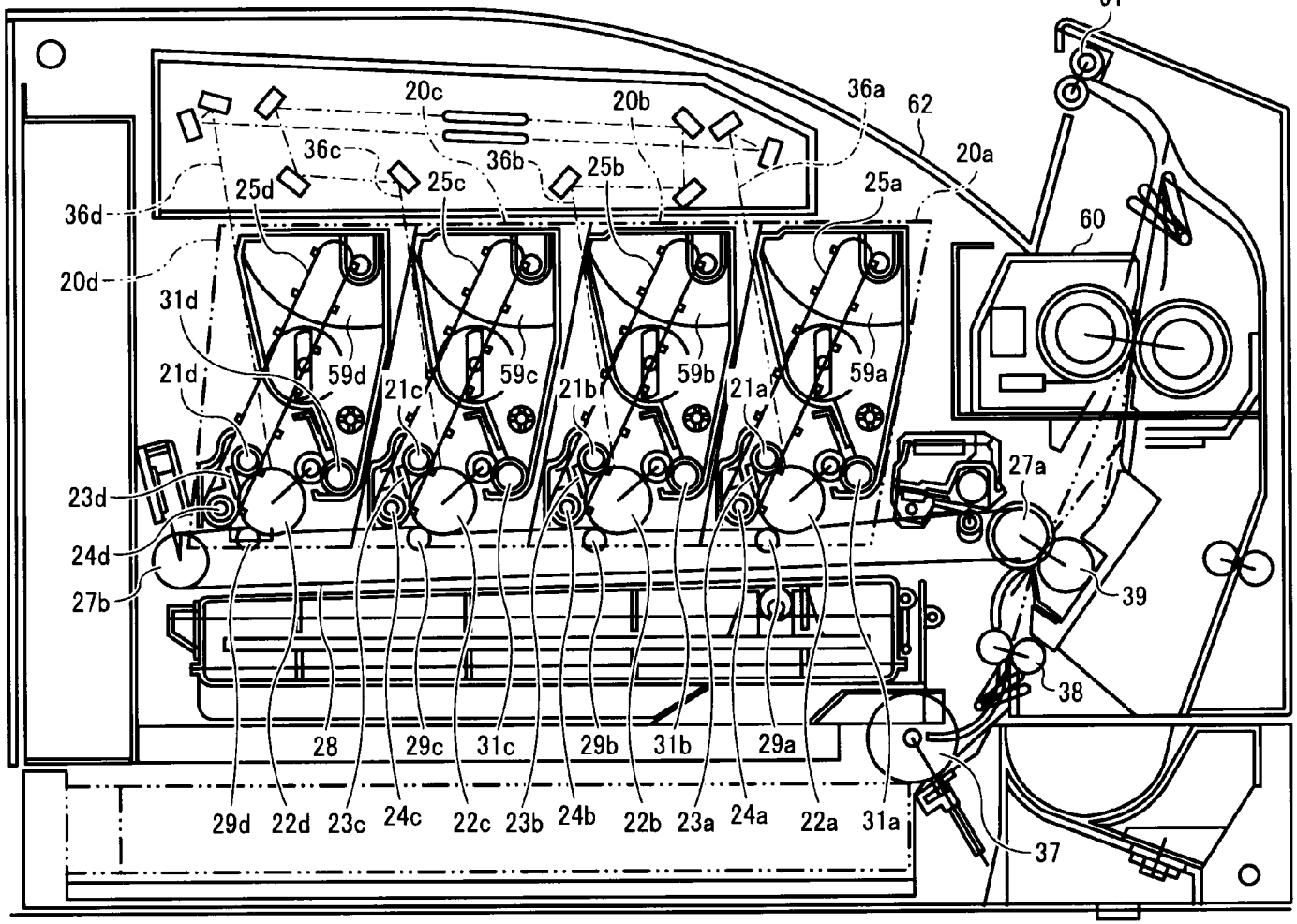
FIG. 1 is a schematic diagram of an image forming apparatus according to an embodiment of the present invention.

FIG. 1 is a schematic diagram of an image forming apparatus 10 according to an embodiment of the present invention. The image forming apparatus 10 includes four image forming units 20*a*, 20*b*, 20*c*, and 20*d* for different colors that are arranged in tandem.

The image forming units 20*a*, 20*b*, 20*c*, and 20*d* each include a drum-like image carrier 22 (22*a*, 22*b*, 22*c*, 22*d*), around which are arranged a charging device 21 (21*a*, 21*b*, 21*c*, 21*d*), a developing device 31 (31*a*, 31*b*, 31*c*, 31*d*), and a cleaning device 23 (23*a*, 23*b*, 23*c*, 23*d*). The charging device 21 uniformly charges the surface of the image carrier 22. The developing device 31 develops an image with developer, i.e., toner, of one of the colors. The cleaning device 23 removes residual toner from the surface of the image carrier 22 after primary transfer. The image forming unit 20 (20*a*, 20*b*, 20*c*, 20*d*) further includes a first waste-toner conveying screw 24 (24*a*, 24*b*, 24*c*, 24*d*), a waste-toner conveyor belt 25 (25*a*, 25*b*, 25*c*, 25*d*), and a waste-toner housing device 59 (59*a*, 59*b*, 59*c*, 59*d*). The first waste-toner conveying screw 24 conveys the residual toner removed by the cleaning device 23 out of the cleaning device 23. The waste-toner conveyor belt 25 conveys the residual toner to the waste-toner housing device 59. The image forming unit 20 is detachably attached to the image forming apparatus 10. The developing device 31 can be built in the image forming unit 20. The image forming apparatus 10 includes an intermediate transfer belt 28 that extends around a driving roller 27*a*, a driven roller 27*b*, and a primary transfer roller 29 (29*a*, 29*b*, 29*c*, 29*d*). The image carrier 22 is exposed to a laser beam 36 (36*a*, 36*b*, 36*c*, 36*d*).

The charging device 21 uniformly charges the surface of the image carrier 22 when negative bias charge is applied to each of the charging devices 21, using a direct current (DC) from other source of bias supply. The image carrier 22*a* of the image forming unit 20*a* is exposed to the laser beam 36*a*. The image carrier 22*b* of the image forming unit 20*b* is exposed to the laser beam 36*b*. Thus, a periphery of the image carrier 22*a*, which is uniformly charged with high voltage charge, is selectively exposed to the laser beam 36*b* based on image data. Low and high voltage areas formed due to the exposure create a latent image. Bias voltage of alternating current (AC) and DC, from a bias supply (not shown), is applied to the center of an image roller 32 of the developing device 31 that creates an electric field. The electric field created on the developing device 31 helps in creating a toner image by developing the latent image.

The toner image is carried by the rotating image carrier 22*a*, and is transferred onto the intermediate transfer belt 28. The image forming unit 20*b* operates in the same manner as previously described for the image carrier 22*a* correspondingly to the timing at which the toner image on the intermediate transfer belt 28 comes in contact with the image carrier 22*b*. Specifically, the developing device 31*b* develops a latent image formed on the image carrier 22*b* into a toner image, and the toner image on the image carrier 22*b* is transferred onto the intermediate transfer belt 28 such that the toner image is superimposed on the previous one. The same operation is performed by the image forming unit 20*c* and the image forming unit 20*d*.

After the image is transferred onto the intermediate transfer belt 28, a cleaning blade in the cleaning device 23 removes residual toner from the surface of the image carrier 22*a*. Thus, the next image forming operation can be performed on the image carrier 22*a*.

Figure 2:
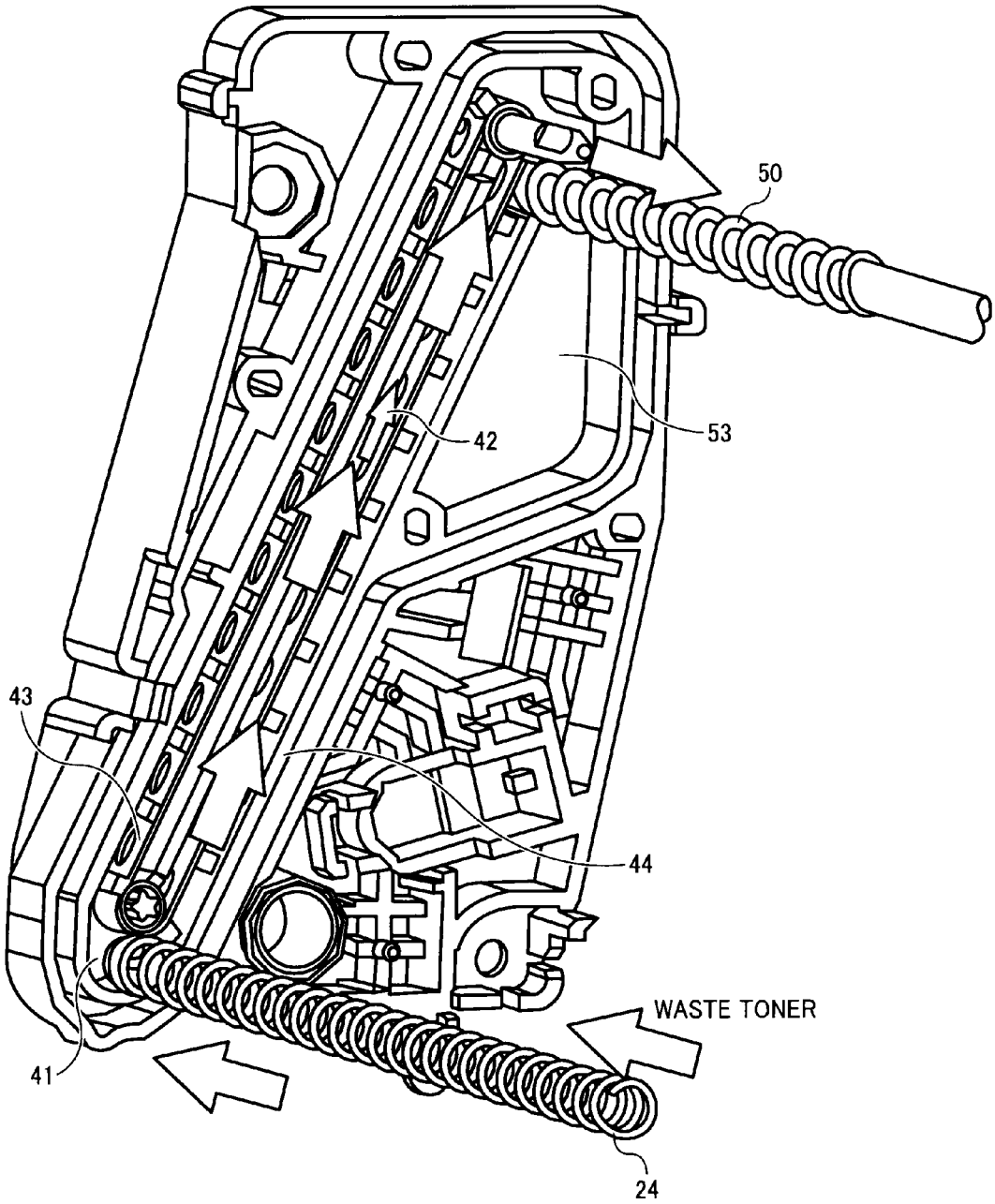
FIG. 2 is a schematic diagram of a waste-toner conveying unit shown in FIG. 1.

FIG. 2 is a schematic diagram of a waste-toner conveying unit for conveying waste toner to the waste-toner housing device 59. The waste-toner housing device 59 includes a waste-toner container 58 for containing waste toner generated in the image forming apparatus 10. The waste-toner container 58 is detachably attached to the image forming apparatus 10, and is shaped able to fit in the spare space within a main body of the image forming apparatus 10. A second waste-toner conveying screw 50 and a third waste-toner conveying screw 51 that agitate and convey the waste toner are arranged inside the waste-toner container 58. A surface of the waste-toner container 58 adjacent to components of the image forming apparatus 10 in the attached position is shaped along shapes of the components. For example, if the components are the cleaning devices 23*a*, 23*b*, 23*c*, and 23*d* each arranged at an angle, the surface of the waste-toner container 58 is inclined in the same direction as a line that links the cleaning devices 23*a*, 23*b*, 23*c*, and 23*d*, or is parallel to the line.

The waste toner is conveyed by the first waste-toner conveying screw 24 to an outlet portion 41. The waste toner is held in between protruding portions 43 on the waste-toner conveyor belt 25, which rotates in a direction of an arrow 42, and an outer wall 44 of a waste-toner conveying path. Thus, the waste toner is conveyed to a waste-toner inlet portion 53.

Figure 3:
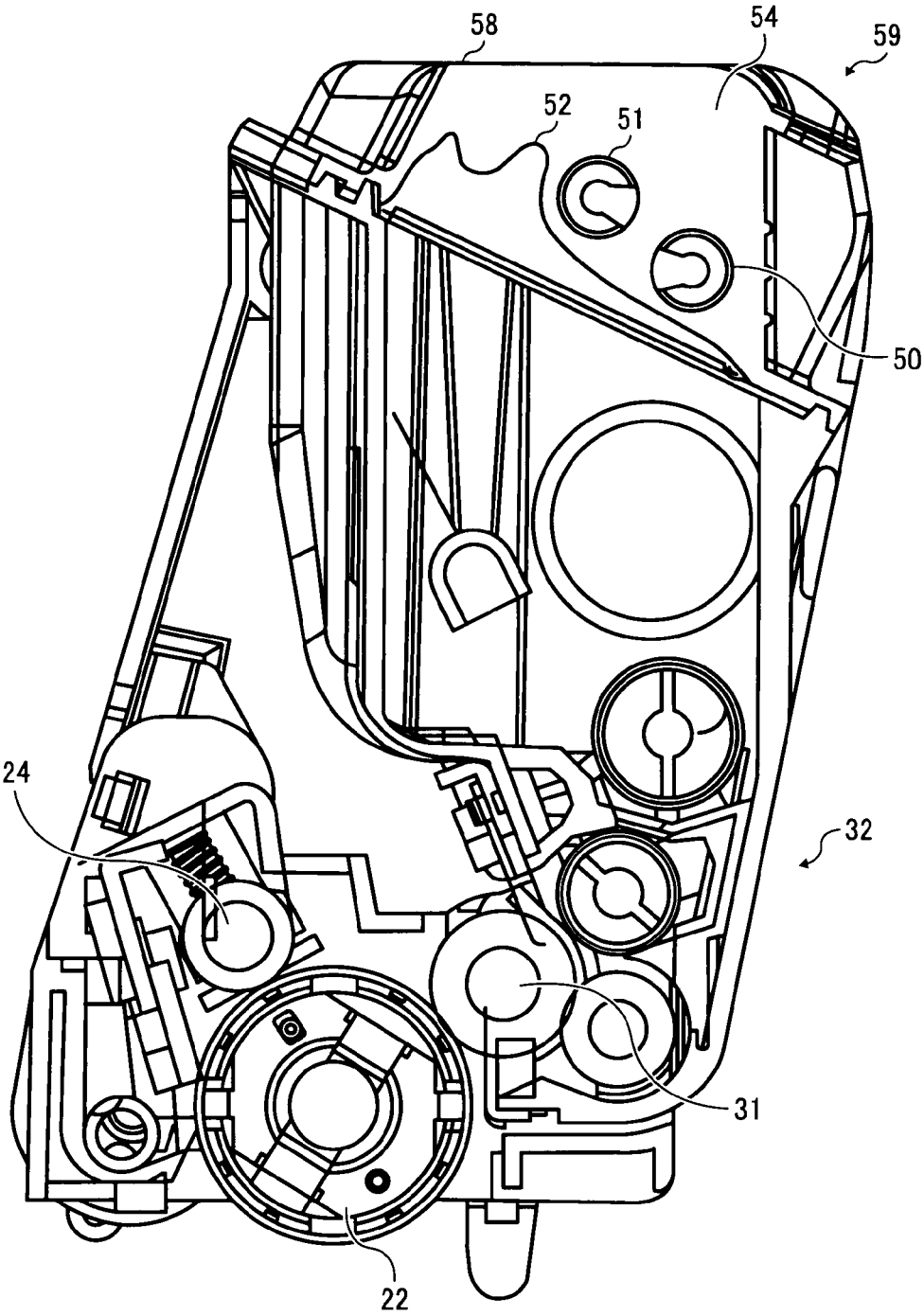
FIG. 3 is a schematic diagram of a waste-toner housing device and relevant parts shown in FIG. 1.

FIG. 3 is a schematic diagram of the waste-toner housing device 59 and relevant parts. The waste-toner housing device 59 includes a waste-toner space 54. Waste toner entered from the waste-toner inlet portion 53 (not shown in FIG. 3) is conveyed by the second waste-toner conveying screw 50 to the waste-toner space 54. When the waste toner is accumulated in the front (inlet) side of the waste-toner space 54, the waste toner is conveyed towards the depth side thereof by the second waste-toner conveying screw 50 and the third waste-toner conveying screw 51. With this configuration, the waste toner can be conveyed to desired areas in a desired order, and the space in the waste-toner container 58 is effectively used. The waste-toner housing device 59 also includes a deformable divider 52 that divides the waste-toner container 58 into a new-toner reservoir and the waste-toner space 54 so that a capacity of the waste-toner space 54 is variable depending on a volume of the waste toner. That is, when new toner is larger in quantity at the initial stage, the capacity of the waste-toner space 54 is small. On the other hand, when waste toner is larger in quantity at the terminal stage, the capacity of the waste-toner space 54 is large.

Figure 4A:
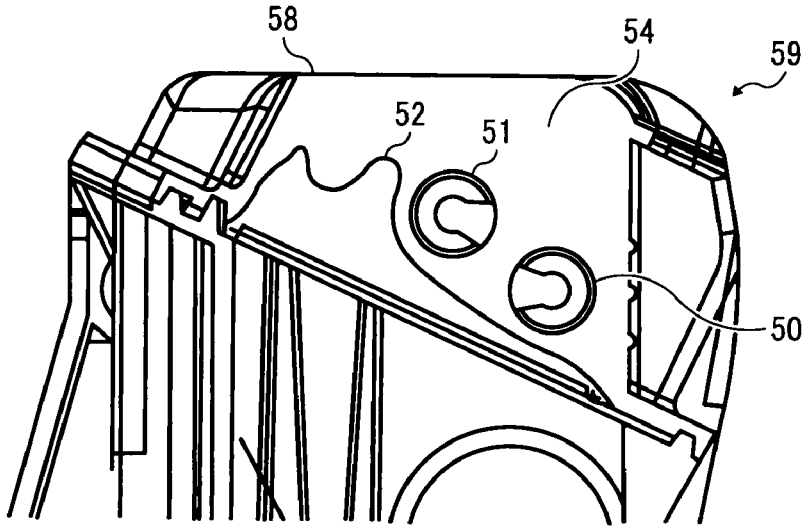
FIGS. 4A and 4B are schematic diagrams for explaining efficiency of a space for waste toner depending on levels on which waste-toner conveying screws shown in FIG. 3 are located.
Figure 4B:
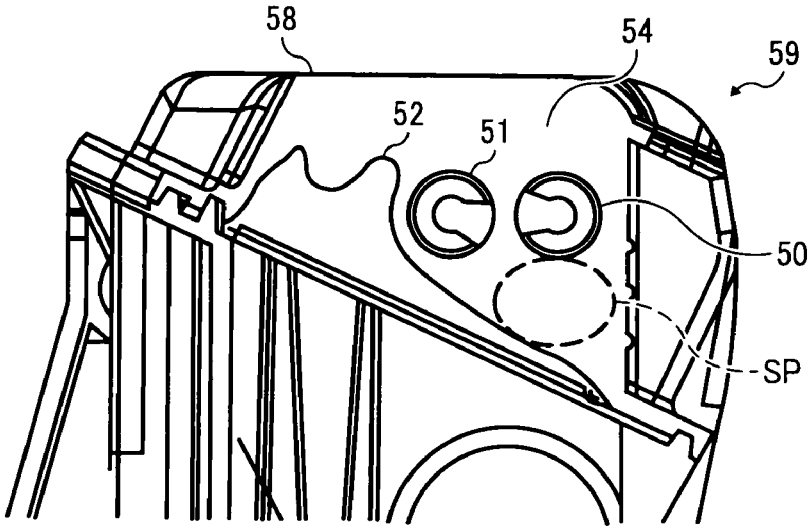

In the waste-toner housing device 59, the second waste-toner conveying screw 50 and the third waste-toner conveying screw 51 are located on different levels in height in the waste-toner container 58. FIGS. 4A and 4B are schematic diagrams for explaining efficiency of the waste-toner space 54 depending on the levels on which the second waste-toner conveying screw 50 and the third waste-toner conveying screw 51 are located. When both the second waste-toner conveying screw 50 and the third waste-toner conveying screw 51 are located on the same level as shown in FIG. 4B, an unfilled space SP indicated by a doted line in FIG. 4B is created, which undermines the effective use of the space in the waste-toner container 58. However, as shown in FIG. 4A, when the second waste-toner conveying screw 50 and the third waste-toner conveying screw 51 are located on different levels, the unfilled space SP is not created. Thus, the space in the waste-toner container 58 is effectively used.

Figure 5:
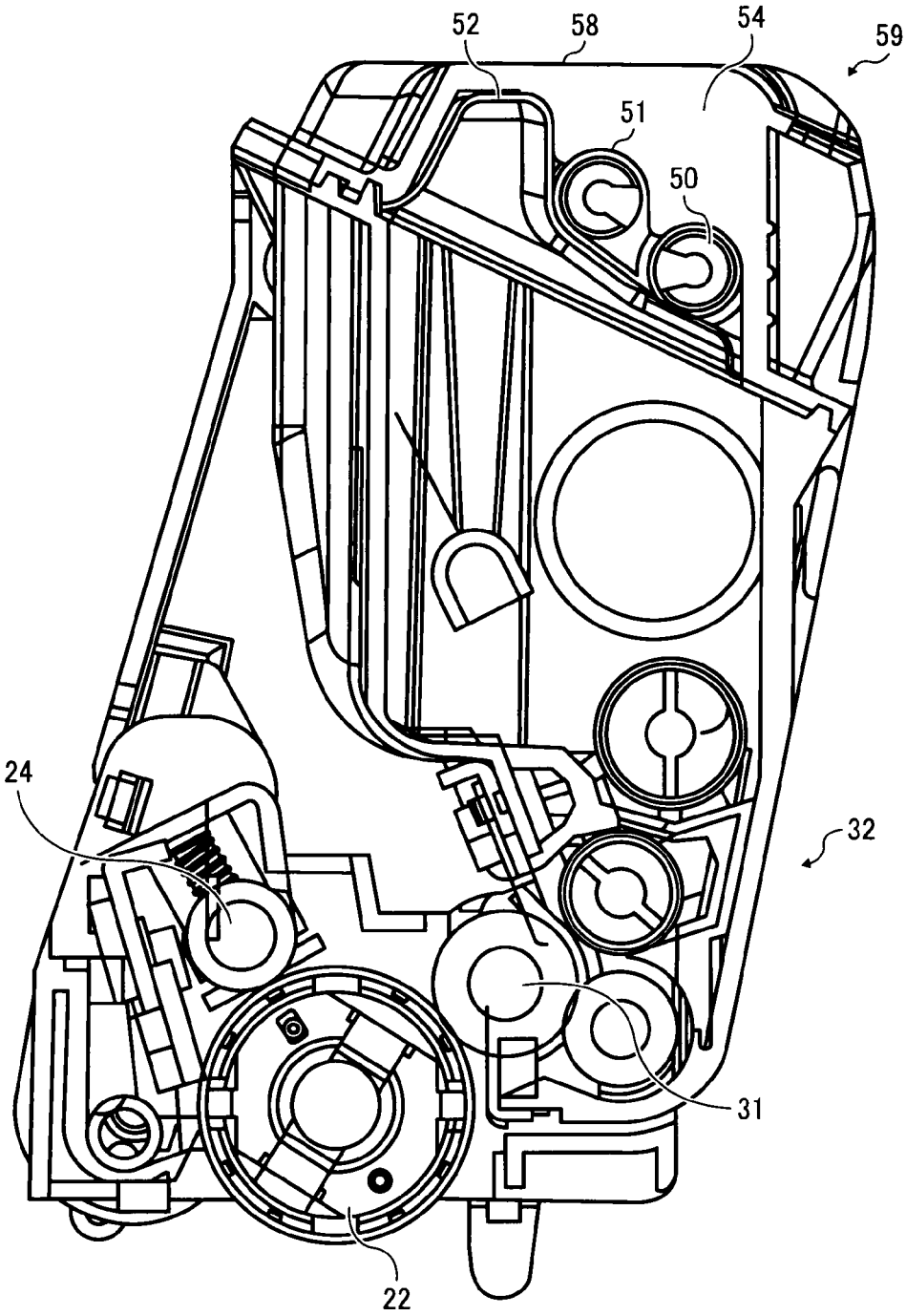
FIG. 5 is a schematic diagram of another example of the waste-toner housing device and relevant parts.
Figure 6:
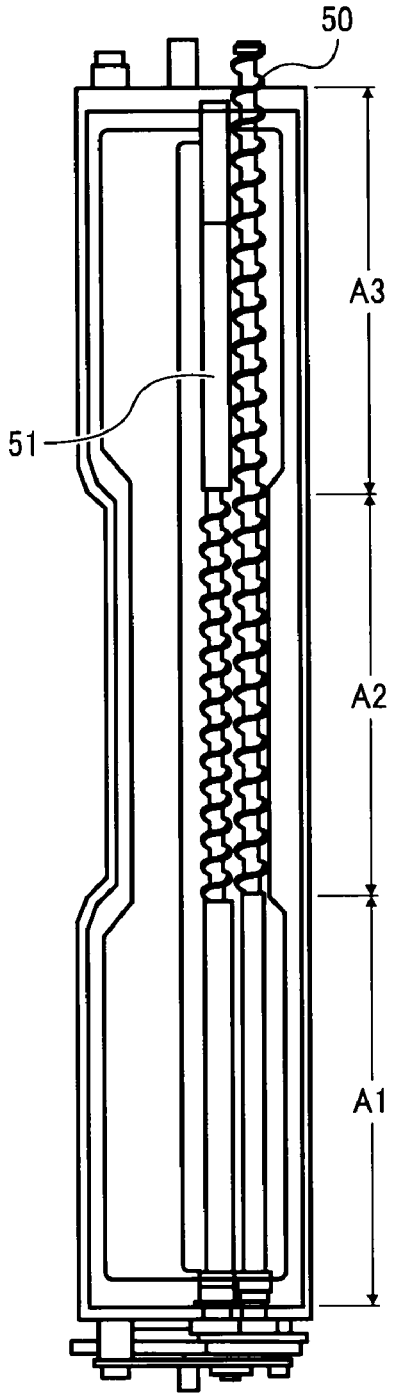
FIG. 6 is an overhead view of the waste-toner housing device shown in FIG. 5.

FIG. 5 is a schematic diagram of the waste-toner housing device 59 including the deformable divider 52. FIG. 6 is an overhead view of the waste-toner housing device 59 shown in FIG. 5. As shown in FIG. 6, the inside of the waste-toner container 58 is separated into Areas A1, A2, and A3. Area A3 is closest to the waste-toner inlet portion 53. Waste toner conveyed by the waste-toner conveyor belt 25 is then conveyed by the second waste-toner conveying screw 50 towards Area A1. When Area A1 is completely filled with waste toner, the third waste-toner conveying screw 51 conveys to Area A2 or A3 waste toner that fails to be filled in Area A1. To effectively deform a shape of the deformable divider 52, there is a need for filling the waste toner in the waste-toner container 58 in an order from Area A1 to A3. However, before Area A1 is completely filled with the waste toner, the waste toner may accumulate in Area A2 or A3. Difference in level of the second waste-toner conveying screw 50 and the third waste-toner conveying screw 51 makes it possible to fill the waste toner in the desirable order from Area A1 to A3. As a result, the space inside the waste-toner container 58 is effectively used. The waste-toner conveying screw extends, from the waste-toner inlet portion, to a point that is located in a range from a one-third to a two-third of a longitudinal length of the waste-toner housing device. This makes it possible to convey the waste toner to Area A1 shown in FIG. 6. As a result, the waste toner first accumulates near the center portion so that the deformable waste-toner space expands around the center portion, that is, the waste-toner space can expand efficiently. The third waste-toner conveying screw 51 extends over one-third of the longitudinal length of the waste-toner housing device 58 at its center portion. This is why the toner accumulating on Area A1 is conveyed by the third waste-toner conveying screw 51 in the opposite direction to Area A3. The waste toner accumulating on Area A3 swells the waste-toner space efficiently. Consequently, there is no wasteful space in the waste-toner container.

The image forming apparatus 10 operates as described below. In the image forming unit 20*a* for black image, the image carrier 22 is charged by the charging device 21*a* and a latent image is formed by the laser beam 36 thereafter. The latent image is developed with black toner by the developing device 31 to form a toner image. The toner image formed on the image carrier 22 is carried by the primary transfer roller 29 and is transferred onto the intermediate transfer belt 28. A surface of the image carrier 22 is cleaned by the cleaning device 23 after the image is transferred, to prepare the image carrier 22 for the next image forming operation.

A transfer sheet P is fed into the image forming apparatus 10 by a paper feed roller 37 and a pair of conveyor rollers 38. The toner image formed on the intermediate transfer belt 28 is transferred onto the transfer sheet P by a secondary transfer roller 39. The transfer sheet P with the toner image passes through a fusing unit 60 for fusing the image and is discharged to a catch tray 62 by a pair of discharging rollers 61.

In the image forming apparatus each of toner containers, the intermediate transfer belt 28, and cartridges are arranged at a tilt and are oriented in the same direction. This allows formation of a compact image forming apparatus. Specifically, the image forming unit 20*a* for black image is located adjacent to a transfer nip. The image forming unit 20*a* is inclined such that the image forming unit 20*a* is lower than the image forming unit 20*d*. Because the black-and-white printing operation is performed most frequently even in the full-color printer, such an arrangement shortens the time required for printing a black-and-white image.

The image forming apparatus 10 includes the waste-toner housing device 59 for housing the waste toner after the image carrier 22 is cleaned. The waste-toner container 58 is configured to be detachable from the image forming apparatus 10 so that the waste-toner container 58 is appropriately exchanged.

When a color image is to be formed in the image forming apparatus 10, the image forming units 20*b*, 20*c*, and 20*d* for yellow, cyan, and magenta perform an identical image forming process performed by the image forming unit 20*a* for black. Thus, toner images for each of the colors are formed, which are then sequentially transferred onto the intermediate transfer belt 28. The transfer sheet P is fed from a paper feed cassette 11. The toner image formed on the intermediate transfer belt 28 is transferred by the secondary transfer roller 39 onto the transfer sheet P. The transfer sheet P, with the toner image, passes through the fusing unit 60. The toner image is fused onto the transfer sheet P in the fusing nip that is formed of a fusing roller and a pressure roller. Thereafter, the transfer sheet P is discharged to the catch tray 62 that is located on the top end surface of the image forming apparatus 10 by the discharging roller 61, which is located downstream of the transfer-sheet conveying path. The residual toner on the intermediate transfer belt 28 is removed by the cleaning device 23 in a similar manner that the image carrier 22 is cleaned and is conveyed by the waste-toner conveying unit to the waste-toner housing device 59.

In the embodiment described above, an image carrier, a charging device, a developing device, a cleaning device, and a waste-toner housing device are integrally formed into one unit that is detachable from the image forming apparatus. However, the waste-toner housing device can be separately detachable from the image forming apparatus. Only the waste-toner housing device and the image carrier can be formed into one unit, or can be formed into one unit with any one of the charging device, the developing device, and the cleaning device.

As set forth hereinabove, according to an embodiment of the present invention, unevenly accumulated waste toner is leveled or smoothed in the waste-toner housing device, so that every part of the waste-toner housing device can be effectively filled with waste toner. Thus, the cycle of exchanging the housing device becomes longer. As a result, frequency of exchanging the waste-toner housing device decreases.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A waste-toner housing device detachably attached to an image forming apparatus for housing waste toner generated in the image forming apparatus, the waste-toner housing device comprising:

a waste-toner container; and a first conveying member and a second conveying member that convey the wasted toner, wherein the first conveying member and the second conveying member are arranged inside the waste-toner container in such a manner that the second conveying member is located on an elevated level with respect to the first conveying member, wherein the waste-toner housing is configured such that the first conveying member and the second conveying member rotate in opposite directions.

2. The waste-toner housing device according to claim 1, further comprising a holding member that rotatably holds the first conveying member and the second conveying member so that the first conveying member and the second conveying member rotate in opposite directions.

3. The waste-toner housing device according to claim 1, further comprising a space for housing the waste toner in the waste-toner container near the second conveying member.

4. The waste-toner housing device according to claim 3, further comprising a deformable member that defines the space according to a volume of the waste toner.

5. The waste-toner housing device according to claim 1, wherein the waste-toner container includes a waste-toner inlet through which waste toner enters into the waste-toner container, and the first conveying member extends, from the waste-toner inlet, equal to or less than two-third of a longitudinal length of the waste-toner container.

6. The waste-toner housing device according to claim 5, wherein the second conveying member agitates waste toner in the waste-toner container, and has a length equal to or less than one-third of a longitudinal length of the waste-toner container and is located at a center of the waste-toner container.

7. The waste-toner housing device according to claim 1, wherein the waste-toner housing device is integrally formed with an image carrier in the image forming apparatus.

8. The waste-toner housing device according to claim 1, wherein the waste-toner housing device is integrally formed with an image carrier and any one of a charging device, a developing device, and a cleaning device in the image forming apparatus.

9. The waste-toner housing device according to claim 8, further comprising:

a deformable divider that divides a space within the waste-toner housing into a new-toner reservoir storing therein toner to be supplied to the developing device and a waste-toner reservoir so that capacities of the new-toner reservoir and the waste-toner reservoir inversely vary as toner from the new-toner reservoir is utilized.

10. The waste-toner housing device according to claim 1, wherein:

the first conveying member and second conveying member are horizontally offset from each other.

11. The waste-toner housing device according to claim 1, wherein:

the first conveying member and second conveying are each horizontal.

12. An image forming apparatus comprising a waste-toner housing device that is detachably attached to the image forming apparatus for housing waste toner, the waste-toner housing device including:

a waste-toner container; and a first conveying member and a second conveying member that convey the wasted toner, wherein the first conveying member and the second conveying member are arranged inside the waste-toner container in such a manner that the second conveying member is located at an elevated level with respect to the first conveying member, wherein the waste-toner housing is configured such that the first conveying member and the second conveying member rotate in opposite directions.

13. The image forming apparatus according to claim 12, wherein:

the first conveying member and second conveying member are horizontally offset from each other.

14. The image forming apparatus according to claim 12, wherein:

the first conveying member and second conveying are each horizontal.

* * * * *